US009574407B2

(12) United States Patent
Clark et al.

(10) Patent No.: US 9,574,407 B2
(45) Date of Patent: Feb. 21, 2017

(54) DRILLING SYSTEMS AND MULTI-FACED DRILL BIT ASSEMBLIES

(71) Applicant: National Oilwell DHT, L.P., Conroe, TX (US)

(72) Inventors: Kevin W. Clark, Montgomery, TX (US); Chinedu I. Nduka, Pearland, TX (US)

(73) Assignee: NATIONAL OILWELL DHT, L.P., Conroe, TX (US)

( * ) Notice: Subject to any disclaimer, the term of this patent is extended or adjusted under 35 U.S.C. 154(b) by 336 days.

(21) Appl. No.: 14/458,351

(22) Filed: Aug. 13, 2014

(65) Prior Publication Data

US 2015/0047905 A1 Feb. 19, 2015

Related U.S. Application Data

(60) Provisional application No. 61/866,871, filed on Aug. 16, 2013.

(51) Int. Cl.
*E21B 10/62* (2006.01)
*E21B 10/627* (2006.01)
*E21B 10/43* (2006.01)

(52) U.S. Cl.
CPC ..... *E21B 10/627* (2013.01); *E21B 10/43* (2013.01)

(58) Field of Classification Search
CPC ..... E21B 10/62; E21B 10/20; E21B 10/42; E21B 10/627; E21B 10/322; E21B 10/32; E21B 10/66; Y10T 407/23
See application file for complete search history.

(56) References Cited

U.S. PATENT DOCUMENTS 2,133,564 A * 10/1938 Patton ..... E21B 4/04 175/104
2,287,714 A * 6/1942 Walker ..... E21B 10/34 175/259
2,746,722 A * 5/1956 Schneider ..... E21B 10/00 175/401
3,552,510 A * 1/1971 Brown ..... E21B 10/66 175/261
3,847,236 A * 11/1974 Coalson ..... E21B 10/20 175/257

(Continued)

OTHER PUBLICATIONS

Canadian Patent Application No. 2,859,539 Office Action dated Jan. 29, 2016 (4 pages).

*Primary Examiner* — Kipp Wallace
(74) *Attorney, Agent, or Firm* — Conley Rose, P.C.

(57) ABSTRACT

A drill bit assembly that includes a shank including a shank axis, first and second ends, a drill bit seat at the second end and a central flow bore extending axially from the first end. Additionally, the assembly includes a sleeve disposed about and translatable axially relative to the shank and a drill bit rotatably coupled to the sleeve. The drill bit includes a first bit face having a first cutting structure configured to engage an earthen formation, and a second bit face having a second cutting structure configured to engage the earthen formation. The drill bit is configured to rotate about the about the shank axis in a cutting direction, and to rotate about an axis of rotation being orthogonal to the shank axis to selectively expose the first or second cutting surface to the earthen formation. The seat is configured to receive the first or second bit face.

18 Claims, 11 Drawing Sheets

(56) References Cited

U.S. PATENT DOCUMENTS

| | | | | |
|---|---|---|---|---|
| 4,651,837 | A * | 3/1987 | Mayfield | E21B 10/66 175/260 |
| 6,131,675 | A * | 10/2000 | Anderson | E21B 10/322 166/55.1 |
| 6,142,250 | A | 11/2000 | Griffin et al. | |
| 6,962,217 | B1 | 11/2005 | Vail, III | |
| 7,293,616 | B2 * | 11/2007 | Tulloch | E21B 10/322 175/267 |
| 2003/0146023 | A1 * | 8/2003 | Pia | E21B 47/091 175/269 |
| 2011/0120774 | A1 * | 5/2011 | Runia | E21B 10/48 175/57 |
| 2013/0098688 | A1 * | 4/2013 | Yong | E21B 10/22 175/227 |

* cited by examiner

DRILLING SYSTEMS AND MULTI-FACED DRILL BIT ASSEMBLIES

CROSS-REFERENCE TO RELATED APPLICATIONS

This application claims benefit of U.S. provisional patent application Ser. No. 61/866,871 filed Aug. 16, 2013, and entitled "Drilling Systems and Multi-Faced Drill Bit Assemblies," which is hereby incorporated herein by reference in its entirety.

STATEMENT REGARDING FEDERALLY SPONSORED RESEARCH OR DEVELOPMENT

Not applicable.

BACKGROUND

Embodiments disclosed herein relate generally to drilling systems and earth-boring drill bits for drilling a borehole for the ultimate recovery of oil, gas, or minerals. More particularly, embodiments disclosed herein relate to drill bits including multiple, selectable bit faces for engaging an earthen formation during drilling operations.

An earth-boring drill bit is connected to the lower end of a drill string and is rotated by rotating the drill string from the surface, with a downhole motor, or by both. With weight-on-bit (WOB) applied, the rotating drill bit engages the formation and proceeds to form a borehole along a predetermined path toward a target zone.

In drilling operations, costs are generally proportional to the length of time it takes to drill the borehole to the desired depth and location. The time required to drill the well, in turn, is greatly affected by the number of times downhole tools must be changed or added during drilling operations. This is the case because each time a downhole tool is changed or added, the entire string of drill pipes, which may be miles long, must be retrieved from the borehole, section-by-section. Once the drill string has been retrieved and the tool changed or added, the drillstring must be constructed section-by-section and lowered back into the borehole. This process, known as a "trip" of the drill string, requires considerable time, effort and expense. Since drilling costs are typically on the order of thousands of dollars per hour, it is desirable to reduce the number of times the drillstring must be tripped to complete the borehole.

During conventional drilling operations, it is often necessary to change or replace the drill bit disposed at the lower end of the drill string once it has become damaged, worn out and/or its cutting effectiveness has sufficiently decreased. In addition, during some drilling operations, it may be desirable to utilize different drill bits having different cutting structures specifically designed for different types of rock in the formation being drilled. Regardless of the specific motivations, each time the drill bit is replaced or changed, a trip of the drillstring must be performed which thus increases the overall time and costs associated with drilling the subterranean wellbore.

BRIEF SUMMARY OF THE DISCLOSURE

Embodiments disclosed herein are directed to a drill bit assemblies for drilling a borehole in an earthen formation. In an embodiment, the drill bit assembly includes a shank having a central shank axis, a first end, and a second end opposite the first end, wherein the shank includes a fluid flow bore extending axially from the first end toward the second end. In addition, the drill bit assembly includes a sleeve concentrically disposed about the shank, wherein the sleeve is configured to translate axially relative to the shank. Further, the drill bit assembly includes an annular chamber radially positioned between the sleeve and the shank and in fluid communication with the fluid flow bore. Still further, the drill bit assembly includes a bit body rotatably coupled to the sleeve, wherein the bit body includes a first bit face having a first cutting structure configured to engage the earthen formation and a second bit face having a second cutting structure configured to engage the earthen formation. The bit body is configured to rotate about the shank axis in a cutting direction and configured to rotate about an axis of rotation oriented orthogonal to the shank axis to selectively expose one of the first cutting structure and the second cutting structure to the earthen formation. The sleeve and the bit body are configured to translate axially relative to the shank in response to a change in a fluid pressure within the annular chamber.

In another embodiment, the drill bit assembly includes a shank having a central shank axis, a first end, and a second end opposite the first end, wherein the shank includes a drill bit seat at the second end and a central flow bore extending axially from the first end toward the second end. In addition, the drill bit assembly includes a sleeve disposed about the shank and configured to translate axially relative to the shank. Further, the drill bit assembly includes a drill bit rotatably coupled to the sleeve. The drill bit includes a first bit face having a first cutting structure configured to engage the earthen formation and a second bit face having a second cutting structure configured to engage the earthen formation. The drill bit is configured to rotate about the about the shank axis in a cutting direction. The drill bit is configured to rotate about an axis of rotation that is orthogonal to the shank axis to selectively expose the first cutting surface or the second cutting surface to the earthen formation. The drill bit seat is configured to mate with and receive the first bit face or the second bit face.

Embodiments disclosed herein are also directed to methods for drilling a borehole in an earthen formation. In an embodiment, the method includes (a) rotatably coupling a drill bit to a sleeve moveably disposed about a shank. In addition, the method includes (b) rotating the drill bit, the sleeve, and the shank about a central axis of the shank after (a), and (c) engaging the earthen formation with a first bit face of the drill bit during (b). Further, the method includes (d) translating the sleeve and drill bit in a first axial direction relative to the shank after (c), and (e) rotating the drill bit about a second axis oriented orthogonal to the first axis during (d) to expose a second bit face of the drill bit to the earthen formation. Still further, the method includes (f) rotating the drill bit about the first axis after (e), and (g) engaging the earthen formation with the second bit face during (f).

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
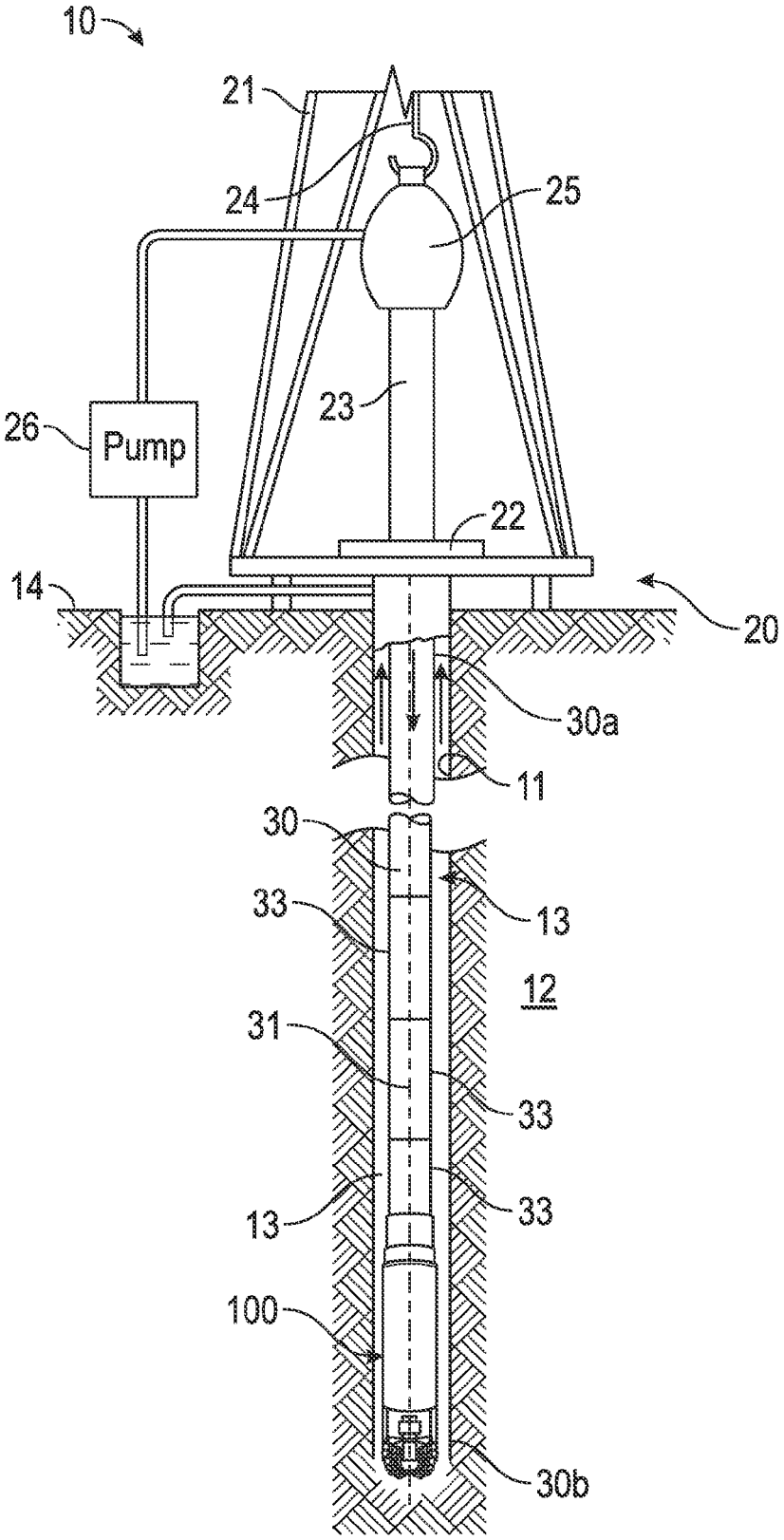
FIG. 1 is a schematic, partial side cross-sectional view of an embodiment of a drilling system including an embodiment of a drilling assembly in accordance with the principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

As previously described, during conventional drilling operations, it is typically desirable to replace the drill bit that is engaging the earthen formation. Each time such a bit replacement is performed the entire drillstring must be tripped to the surface, thus greatly increasing the costs of performing drilling operations. Accordingly, embodiments disclosed herein include drill bit assemblies that include multiple, selectable bit faces that allow a bit replacement or bit change to be performed without needing to perform a trip of the drillstring.

Referring now to FIG. 1, an embodiment of a drilling system 10 is schematically shown. In this embodiment, drilling system 10 includes a drilling rig 20 positioned over a borehole 11 penetrating a subsurface formation 12 and a drillstring 30 suspended in borehole 11 from a derrick 21 of rig 20. Drillstring 30 has a central or longitudinal axis 31, a first or uphole end 30*a* coupled to derrick 21, and a second or downhole end 30*b* opposite end 30*a*. In addition, drillstring 30 includes a drilling assembly 100 at downhole end 30*b* and a plurality of pipe joints 33 extending from assembly 100 to uphole end 30*a*. Pipe joints 33 are connected end-to-end, and drilling assembly 100 is connected to the lower end of the lowermost pipe joint 33. A bottomhole assembly (BHA) can be disposed along drillstring 30 proximal drilling assembly 100 (e.g., axially between lowermost pipe joint 33 and drilling assembly 100).

In this embodiment, drilling assembly 100 is rotated by rotation of drillstring 30 from the surface 14. In particular, drillstring 30 is rotated by a rotary table 22 that engages a kelly 23 coupled to uphole end 30*a* of drillstring 30. Kelly 23, and hence drillstring 30, is suspended from a hook 24 attached to a traveling block (not shown) with a rotary swivel 25 which permits rotation of drillstring 30 relative to derrick 21. Although drilling assembly 100 is rotated from the surface with rotary table 22 and drillstring 30 in this embodiment, in general, the drilling assembly 100 can be rotated with a rotary table or a top drive disposed at the surface, a downhole mud motor disposed in a BHA, or combinations thereof (e.g., rotated by both rotary table via the drillstring and the mud motor, rotated by a top drive and the mud motor, etc.). For example, rotation via a downhole motor may be employed to supplement the rotational power of a rotary table 22, if required, and/or to effect changes in the drilling process. Thus, it should be appreciated that the various aspects disclosed herein are adapted for employment in each of these drilling configurations and are not limited to conventional rotary drilling operations.

During drilling operations, a mud pump 26 at the surface 14 pumps drilling fluid or mud down the interior of drillstring 30 via a port in swivel 25. The drilling fluid exits drillstring 30 through ports or nozzles in the face of drilling assembly 100, and then circulates back to the surface 14 through the annulus 13 between drillstring 30 and the sidewall of borehole 11. The drilling fluid functions to lubricate and cool drilling assembly 100, and carry formation cuttings to the surface 14.

Figure 2:
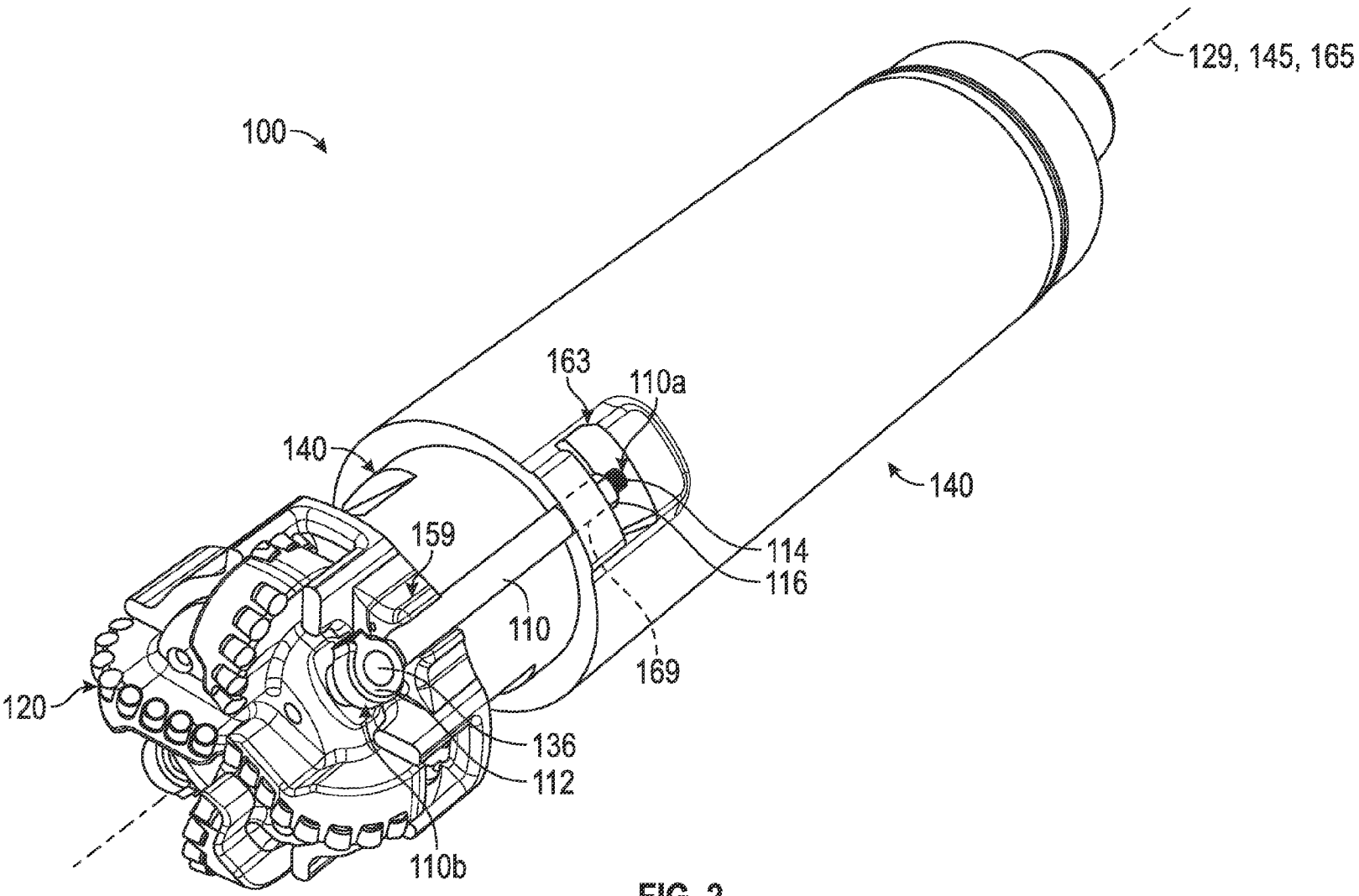
FIG. 2 is a perspective view of the drilling assembly of FIG. 1.
Figure 3:
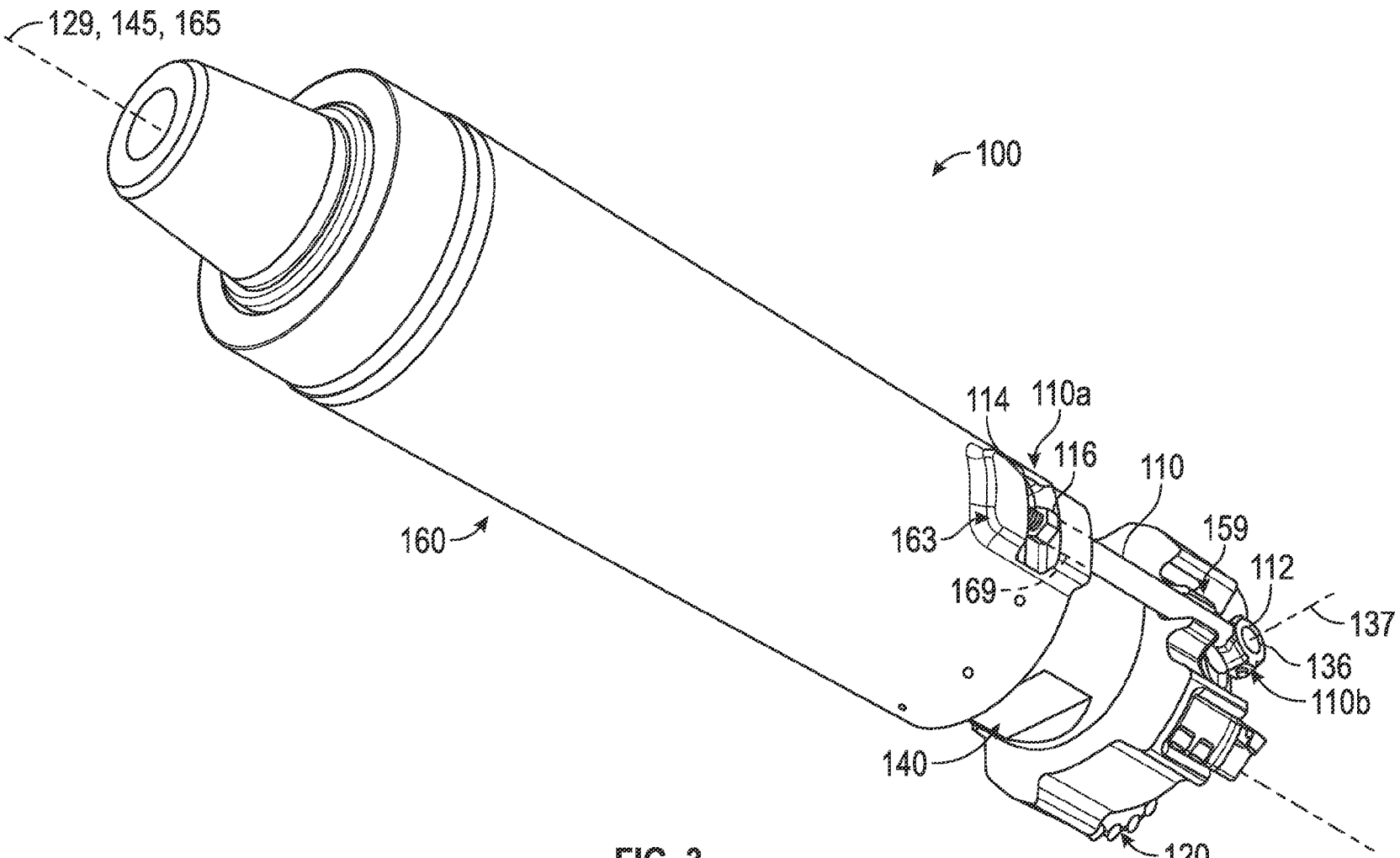
FIG. 3 is another perspective view of the drilling assembly of FIG. 1.

Referring now to FIGS. 2 and 3, drilling assembly 100 is shown. In this embodiment, drilling assembly 100 includes a multi-faced drill bit 120, an elongate shank 140 coupled to bit 120, and an actuating sleeve 160 coupled to shank 140. As shown in FIGS. 2 and 3, sleeve 160 is disposed about shank 140 and bit 120 is coupled to sleeve 160 with a pair of elongate lift arms 110. As will be described in more detail below, drill bit 120 and sleeve 160 can be moved axially relative to shank 140, shank 140 can be moved into and out of engagement with drill bit 120, and drill bit 120 can be rotated relative to sleeve 160 and shank 140.

Figure 4:
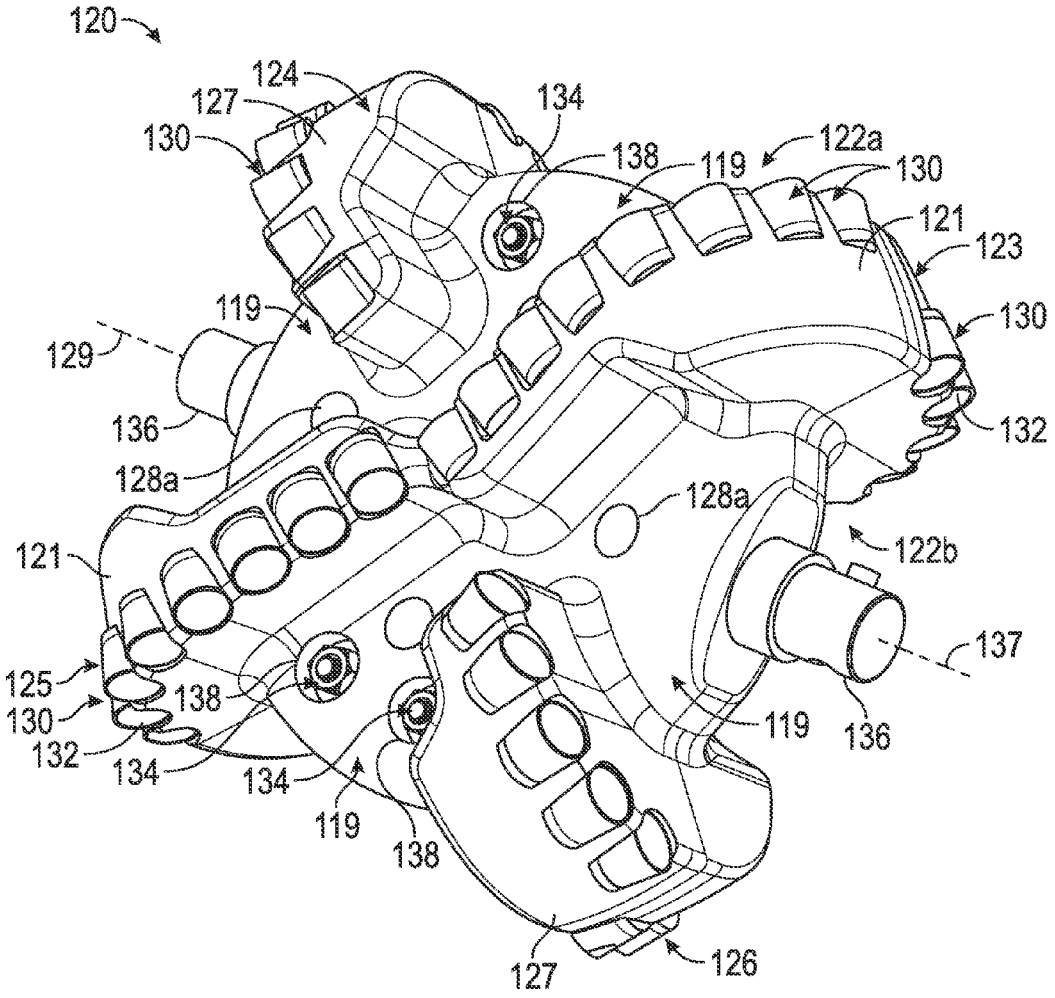
FIG. 4 is a perspective view of the drill bit of FIG. 2.
Figure 5:
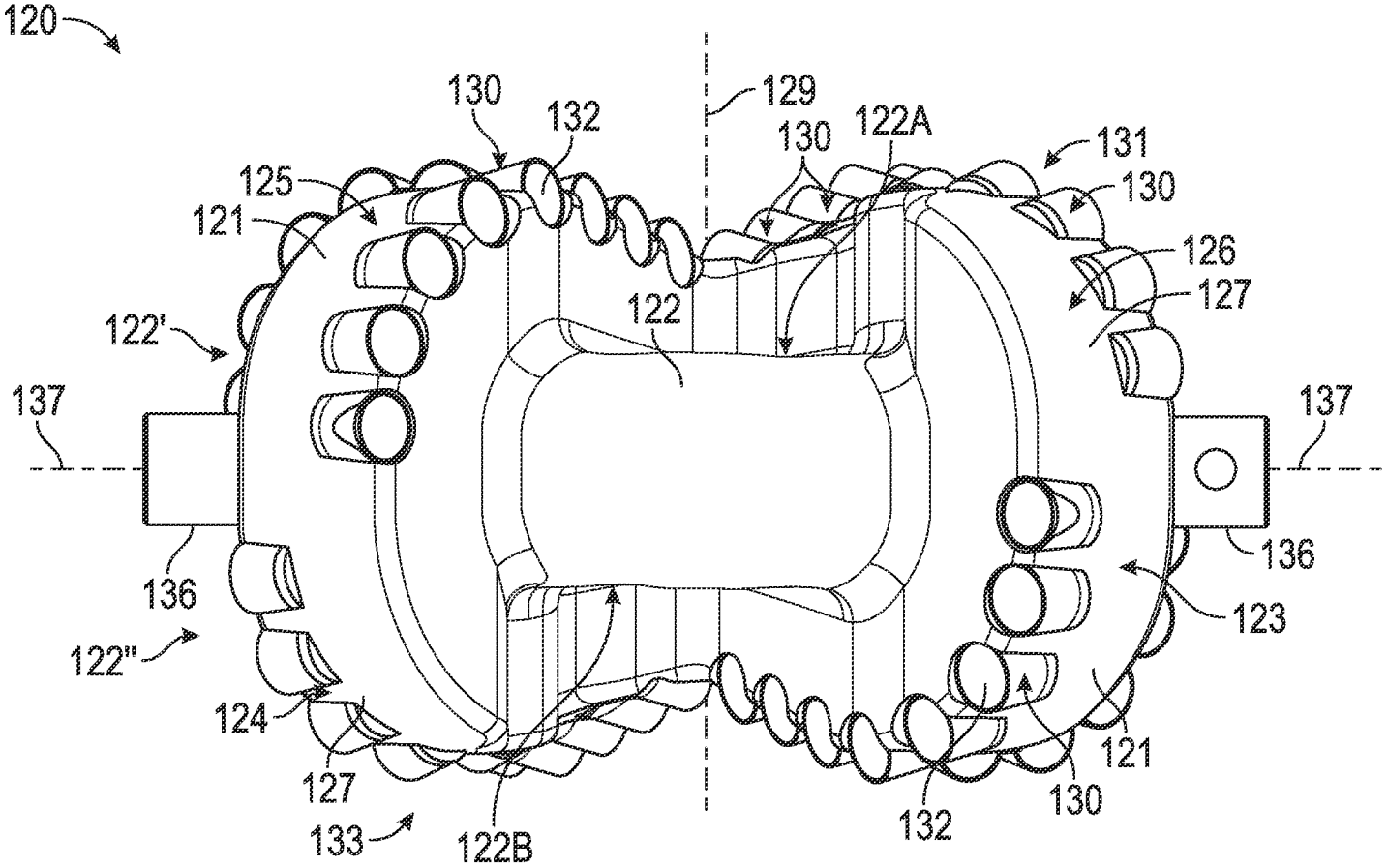
FIG. 5 is a side view of the drill bit of FIG. 2.

Referring now to FIGS. 4 and 5, drill bit 120 includes a bit body 122 having a central bit axis 129, a first bit face 122*a*, and a second bit face 122*b*. As will be described in more detail below, in this embodiment, each bit face 122*a*, 122*b* is a fixed cutter bit face. In addition, face 122*a* is axially opposite face 122*a*, and faces 122*a*, 122*b* are spaced 180° apart and face opposite axial directions. In general, bit body 122 can be formed by any suitable conventional manner, such as, for example, by placing powered metal tungsten carbide particles in a binder material to form a hard metal case matrix. As another example, in some embodiments, body 122 can be machined from a metal block, such as a steel block, rather than being formed from a matrix.

First face 122*a* includes a cutting structure 131 comprising a first plurality of blades that extend radially along and axially outward from face 122*a*. As is best shown in FIG. 4, in this embodiment the first plurality of blades comprise a pair of circumferentially-spaced primary blades 123, 125 arranged about the bit axis 129 and a pair of circumferentially-spaced secondary blades 124, 126 arranged about the bit axis 129. In this embodiment, primary blades 123, 125 and secondary blades 124, 126 are circumferentially arranged in an alternating fashion. Thus, each secondary blade 124, 126 is disposed between the pair of primary blades 123, 125. Further, in this embodiment, the plurality of blades (e.g., primary blades 123, 125 and secondary blades 124, 126) are uniformly angularly spaced about first face 122*a* of bit 120. In particular, the two primary blades 123, 125 are uniformly angularly spaced about 180° apart, the two secondary blades 124, 126 are uniformly angularly spaced about 180° apart, and each primary blade 124, 126 is angularly spaced about 90° from each circumferentially adjacent secondary blade 123, 125. In other embodiments one or more of the primary and/or second blades (e.g., blades 123-126) may be non-uniformly angularly spaced about the upper face 122*a*. Moreover, although face 122*a* of bit 120 is shown as having two primary blades 123, 125 and two secondary blades 124, 126, in general the first face (e.g., first face 122*a*) can comprise any suitable number of primary and/or secondary blades. As one example only, the first face can include three primary blades and three secondary blades.

In this embodiment, primary blades 123, 125 and secondary blades 124, 126 are integrally formed as a part of, and extend from, first face 122*a* of bit body 122. In particular, primary blades 123, 125 and secondary blades 124, 126 extend generally radially along bit face 122*a* and then axially along a portion of the periphery of bit 120. In particular, primary blades 123, 125 extend radially from proximal bit axis 129 toward the periphery of bit 120. Thus, as used herein, the term "primary blade" may be used to refer to a blade begins proximal the bit axis (e.g., bit axis 129) and extends generally radially along the bit face to the periphery of the bit. However, secondary blades 124, 126 are not positioned proximal bit axis 129, but rather, extend radially along first face 122*a* from a location or point that is distal bit axis 129 toward the periphery of bit 120. Thus, as used herein, the term "secondary blade" may be used to refer to a blade that begins at some distance from the bit axis (e.g., bit axis 129) and extends generally radially along the bit face to the periphery of the bit. Primary blades 123, 125 and secondary blades 124, 126 are separated by drilling fluid flow courses 119.

Referring still to FIGS. 4 and 5, each primary blade 123, 125 includes a cutter-supporting surface 121 for mounting a plurality of cutter elements, and each secondary blade 124, 126 includes a cutter-supporting surface 127 for mounting a plurality of cutter elements. A plurality of primary cutter elements 130, each having a primary cutting face 132, are mounted to cutter-supporting surfaces 121, 127 of each primary blade 123, 125 and each secondary blade 124, 126, respectively. In particular, primary cutter elements 130 are arranged adjacent one another in a radially extending row proximal the leading edge of each primary blade 123, 125 and each secondary blade 124, 126. Consequently, as used herein, the term "primary cutter element" refers to a cutter element that does not trail or track any other cutter elements on the same blade when the bit is rotated in the cutting direction.

Although primary cutter elements 130 are shown as being arranged in rows, primary cutter elements 130 can be mounted in other suitable arrangements. Examples of suitable arrangements may include without limitation, rows, arrays or organized patterns, randomly, sinusoidal pattern, or combinations thereof. In other embodiments, additional rows of cutter elements (e.g., a second or backup row, a tertiary row, etc.) may be provided on one or more primary blade(s), secondary blade(s), or combinations thereof.

Second face 122*b* includes a cutting structure 133 comprising a second plurality of blades that extend radially along and axially outward from face 122*b*. In this embodiment, second face 122*b* is identical to face 122*a* such that the second plurality of blades is identical to the first plurality of blades (e.g., blades 123, 124, 125, 126). As a result, the description above regarding the first face 122*a* can be applied to fully describe the second face 122*b*, and like numerals are used to refer to like components.

Referring still to FIGS. 4 and 5, in this embodiment, body 122 comprises two portions or halves that are secured together. In particular, body 122 comprises a first half or portion 122' that carries first face 122*a*, and a second half or portion 122" that carries second face 122*b*. As is best shown in FIG. 5, in this embodiment, the portions 122', 122" are coupled to one another such that each blade 123, 124, 125, 126 on the first face 122*a* is circumferentially-aligned with one blade 123, 124, 125, 126, respectively, on the second face 122*b*. However, in other embodiments, one or more blades of one bit face are not circumferentially-aligned with a blade on the other face. In addition, as is best shown in FIG. 4, in this embodiment, each of the portions 122', 122" are releasably attached to one another through a plurality of bolts 134 extending through aligned mating bores 138 oriented parallel to bit axis 129. However, it should be appreciated that in other embodiments, the bit halves (e.g., portions 122', 122") can be permanently attached (e.g., via welding) or releasably coupled to one another through other suitable means known in the art. Still further, in some embodiments, the bit (e.g., bit 120) including opposed bit faces (e.g., faces 122*a*, 122*b*) is monolithically formed as a single, integral structure.

Figure 7:
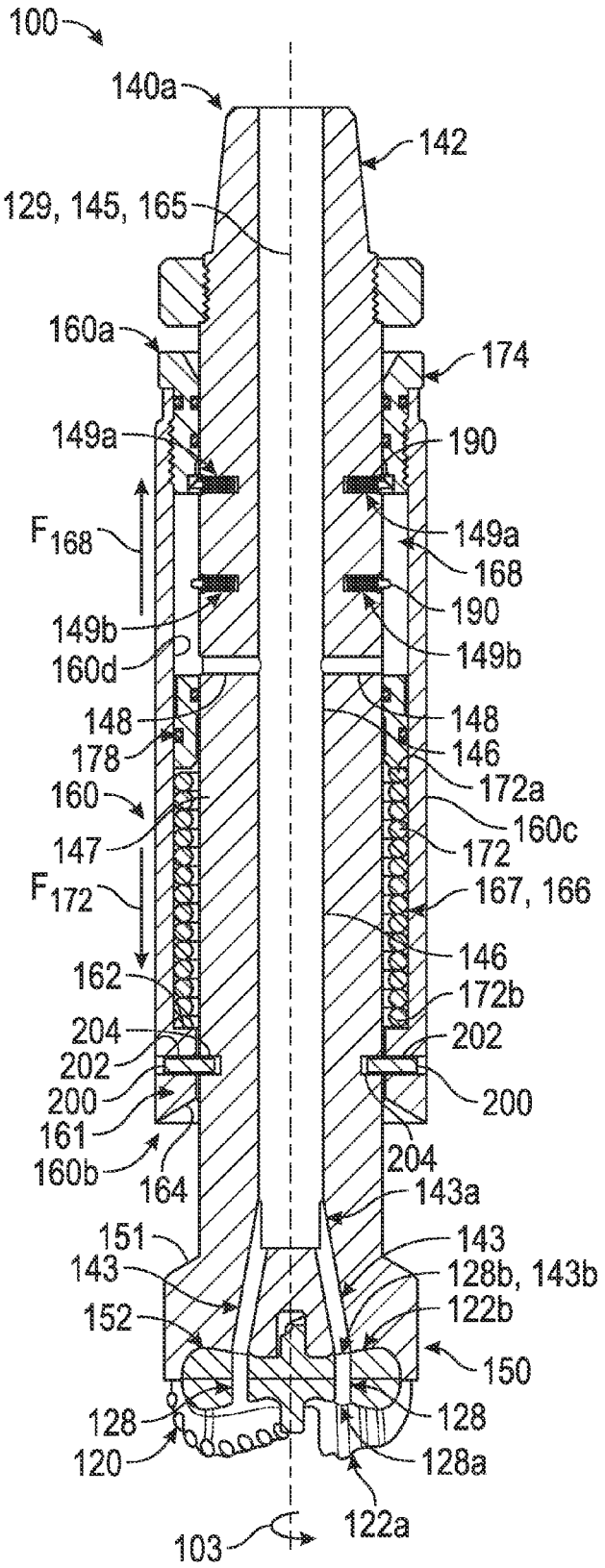
FIG. 7 is a schematic cross-sectional side view of the drilling assembly of FIG. 2.

Referring briefly to FIGS. 4 and 7, drill bit 120 also includes a plurality of flow bores 128 extending axially through body 122 between faces 122*a*, 122*b*. Each flow bore 128 includes a first opening 128*a* in the first face 122*a* and a second opening 128*b* in the second face 122*b*. As will be described in more detail below, each bore 128 provides a channel or flow path for drilling fluids (e.g., drilling mud) through bit 120 during drilling operations.

Referring again to FIGS. 4 and 5, a pair of circumferentially-spaced hinge pins 136 extend radially outward from body 122. Pins 136 are coaxially aligned, spaced 180° apart, and share a common central axis 137 oriented orthogonal to the bit axis 129. In this embodiment, each pin 136 is substantially cylindrical in shape and is secured to body 122 through any suitable device or method. For example, in this embodiment, each pin 136 is threadably engaged within a mating bore (not specifically shown) extending radially into body 122. As will be described in more detail below, bit 120 is rotatably coupled to assembly 100 through pins 136 such that bit 120 may rotate about the axis 130 to selectively expose the first face 122*a* or the second face 122*b* to the earthen formation (e.g., formation 12) during drilling operations.

Figure 6:
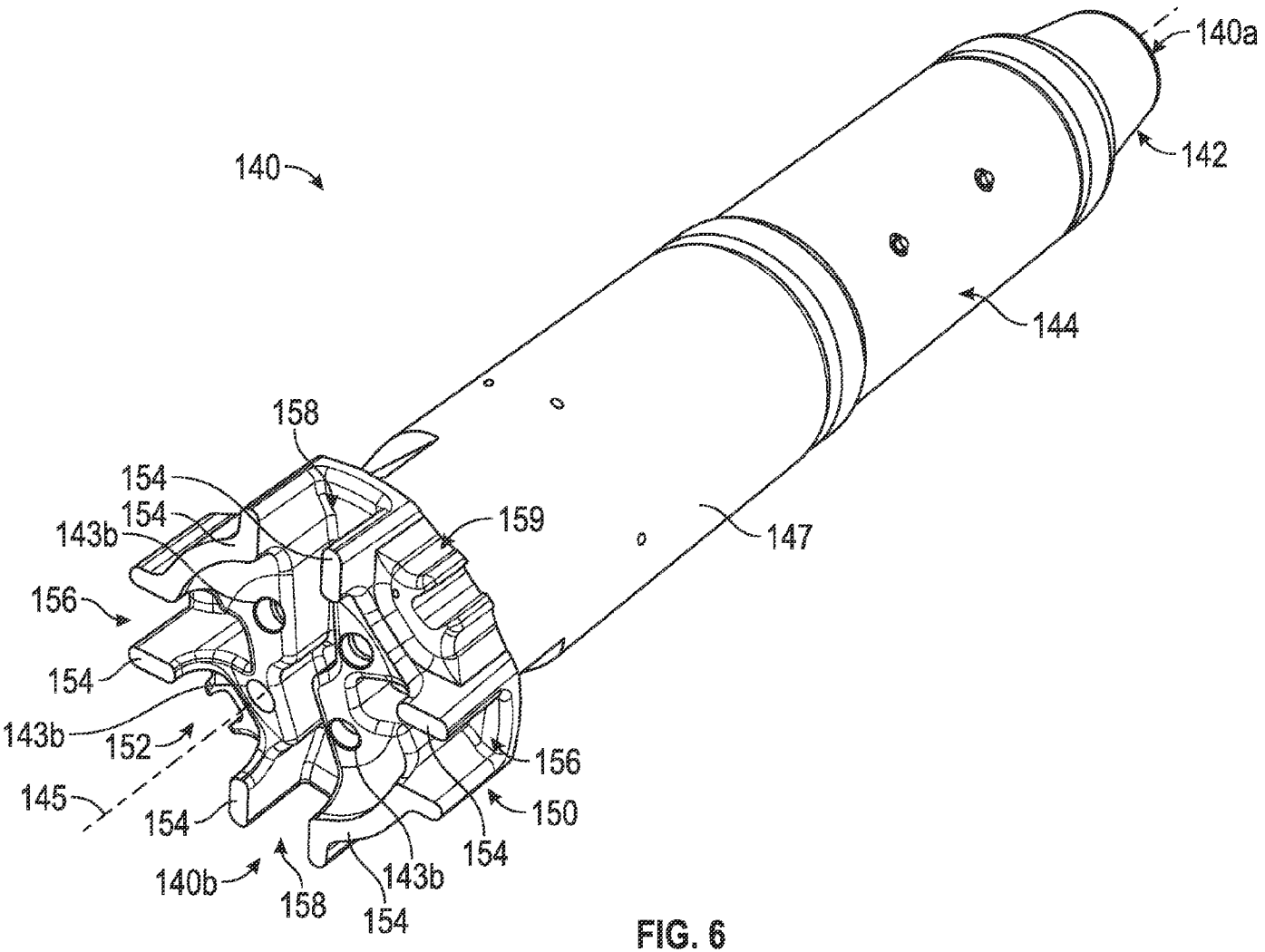
FIG. 6 is a perspective view of the shank of FIG. 2.

Referring now to FIGS. 6 and 7, shank 140 has a central or longitudinal axis 145, a first or upper end 140*a*, a second or lower end 140*b* axially opposite the upper end 140*a*. In addition, shank 140 includes an elongate generally cylindrical shank body 144 and a drill bit seat 150. Seat 150 is disposed at end 140*b*, and body 144 extends from end 140*a* to seat 150. In addition, shank body 144 has a radially outermost surface 147 extending axially between from end 140*a* to seat 150. In this embodiment, upper end 140*a* comprises a male pin-end threaded connector 142 configured to threadably engage with a corresponding box-end connector (not shown) disposed on lower end 30*b* of drillstring 30 (see FIG. 1). As is best shown in FIG. 7, a central flow bore 146 extends axially through shank 140 between ends 140*a*, 140*b*, and provides a flowpath for drilling fluids (e.g., drilling mud) during operations. In addition, a pair of radial flow ports 148 are axially positioned between connector 142 and seat 150, and extend radially between flow bore 146 and outer surface 147. Further, a first plurality of radially oriented ports 149*a* extend into body 144 and are axially spaced between the ports 148 and end 140*a*, and a second plurality of radially oriented ports 149 extend into body 144 and are axially spaced between the ports 148 and the ports 149*a*. In this embodiment, the first plurality of ports 149*a* comprises four uniformly circumferentially-spaced ports 149*a* (e.g., 90° apart), and the second plurality of ports 149*b* comprises four uniformly circumferentially-spaced ports 149*b* (e.g., 90° apart). Also, in this embodiment, each of the ports 149*a*, 149*b* extend radially inward to body 144 from surface 147. However, it should be appreciated that the number and arrangement of ports 149*a*, 149*b* and/or ports 148 can be varied while still complying with the principles disclosed herein.

Referring still to FIGS. 6 and 7, drill bit seat 150 comprises a receptacle 152 that is defined by a plurality of axially oriented retainer walls 154 and extends axially from the lower end 140*b* of shank 140. A plurality of recesses or channels are formed in the receptacle 152 that extend generally axially into seat 150. In particular, in this embodiment, the plurality recesses includes a pair of primary recesses 156 and a pair of secondary recesses 158. Each of the primary recesses 156 extend generally radially from axis 145 to the radially outermost surface of the walls 154, and each of the secondary recesses 158 extends generally radially from a location that is proximate the axis 145 to the radially outermost surface of the retaining walls 154. Thus, as used herein, the term "primary recess" refers to a recess that extends from the central axis (e.g., axis 145) of a shank body, and the term "secondary recess" refers to a recess that extends from a point that is proximate the central axis of a shank body. Further, in this embodiment, the specific arrangement, sizing, and orientation of the primary recesses 156 and the secondary recesses 158 is chosen to correspond with the arrangement and orientation of primary blades 123, 125 and secondary blades 124, 126 on the faces 122*a*, 122*b* of bit 120, previously described. Thus, during operation, each of the primary recesses 156 is configured to receive one of the primary blades 123, 125, and each of the secondary recesses 158 is configured to receive one of the secondary blades 124, 126.

In addition, as is best shown in FIG. 7, a plurality of flow nozzles 143 extend from flow bore 146 toward the lower end 140*b*. In particular, each nozzle 143 includes a first or upper end 143*a* and a second or lower end 143*b*. The upper end 143*a* of each nozzle 143 is in fluid communication with flow bore 146 while the lower end 143*b* of each nozzle 143 is in fluid communication with the receptacle 152 of seat 150. While only two nozzles 143 are shown in FIG. 7, it should be appreciated that in this embodiment there are a total of four such nozzles 143 disposed within shank 140 (note: the lower end 143*b* of each of the nozzles is visible in FIG. 6). Also, it should further be appreciated that in other embodiments, the number and arrangement of nozzles 143 may be varied while still complying with the principles disclosed herein. As will be described in more detail below, in this embodiment, each of the nozzles 143 is configured to substantially align with one of the bores 128 in bit 120 such that flow bore 146 is in fluid communication with each of the faces 122*a*, 122*b* of bit 120 through nozzles 143 and bores 128 during operation.

Referring again to FIG. 6, a pair of guides 159 extend axially along seat 150 on radially opposite sides thereof. As will be described in more detail below, each guide 159 slidingly receives one of the lift arms 110 coupling sleeve 160 to bit 120 during operation. In addition, seat 150 includes a upward facing frustoconical landing shoulder 151 that, as will be described in more detail below, provides a landing surface for sleeve 160 during operation.

Referring again to FIG. 7, sleeve 160 has a central longitudinal axis 165 coaxially aligned with the axes 129, 145 during drilling operations, a first or upper end 160*a*, a second or lower end 160*b* opposite the upper end 160*a*, an annular projection 161 at the lower end 160*b*, a radially outer surface 160*c* extending axially between end 160*a* and projection 161, and a radially inner surface 160*d* extending axially between the ends 160*a*, 160*b*. Projection 161 includes a downward facing frustoconical shoulder 164 proximate the lower end 160*b*, that is configured to engage with shoulder 151 of seat 150, previously described, during operation, and an upward facing annular shoulder 162, distal the shoulder 164 and end 160*b*.

In addition, referring briefly again to FIGS. 2 and 3, sleeve 160 further includes a pair of radial projections 163 extending radially outward from the radially outer surface 160*c* proximate the lower end 160*b*. Each of the projections 163 are circumferentially disposed approximately 180° from the one another about axis 165 such that the projections 163 are on radially opposite sides of sleeve 160. Each projection 163 also includes an axially oriented throughbore 169 (note: throughbore 169 is shown with a hidden line in FIGS. 2 and 3), that, as will be described in more detail below, is configured to receive an end of one of the lifting arms 110 during operation.

Figure 8:
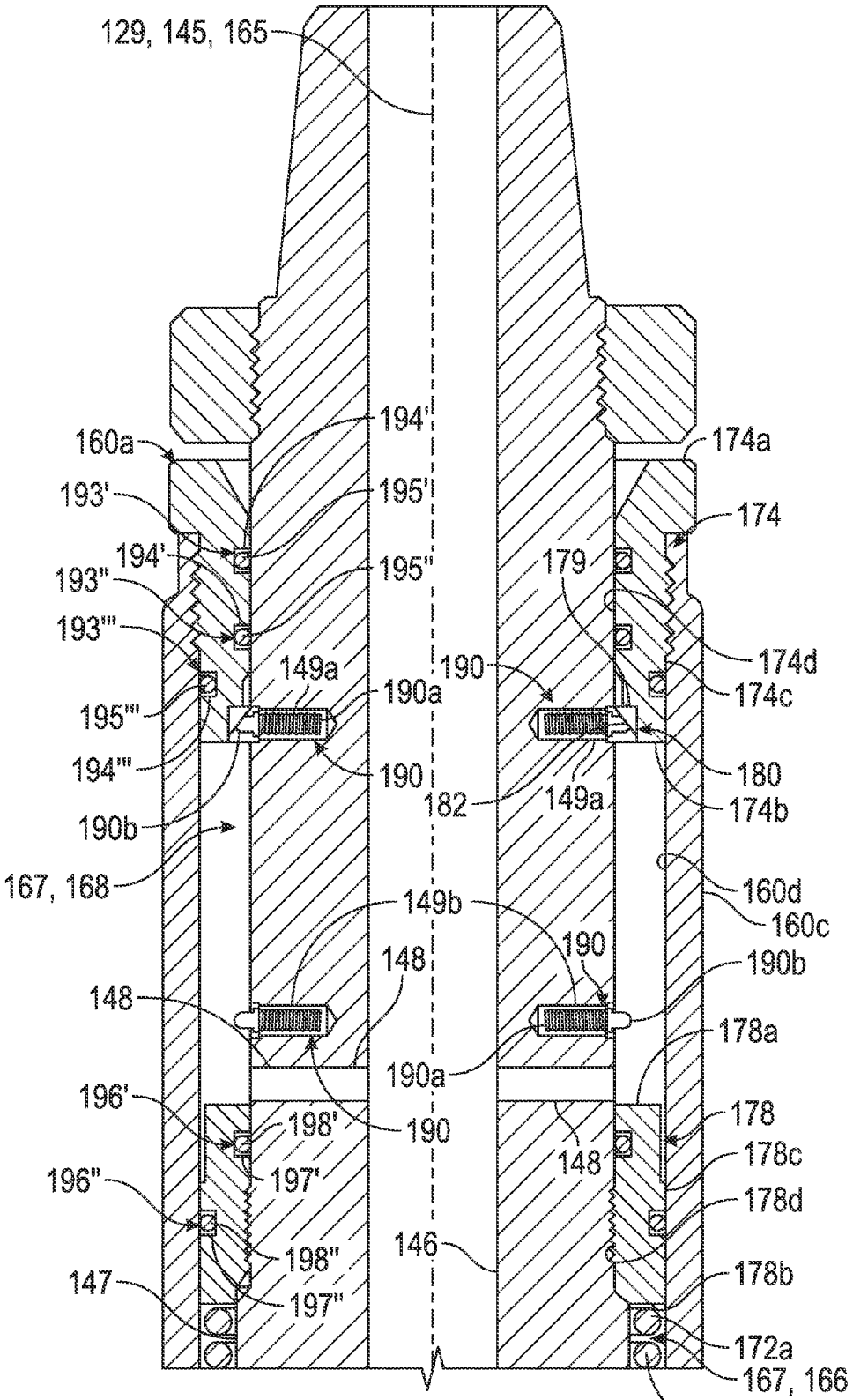
FIG. 8 is an enlarged, schematic cross-sectional side view of a portion of the drilling assembly of FIG. 2.

Referring now to FIGS. 7 and 8, sleeve 160 is disposed about body 144 of shank 140 such that an annular chamber 167 is formed radially between radially outermost surface 147 of body 144 and radially inner surface 160*d* of sleeve 160 and extending axially from shoulder 162 of upper end 160*a*. An annular sleeve member 178 is disposed within chamber 167 and secured to body 144 such that the axial position of member 178 is fixed relative to body 144. Sleeve member 178 includes a first or upper end 178*a*, a second or lower end 178*b* opposite the upper end 178*a*, a radially outer surface 178*c*, and a radially inner surface 178*d*. In this embodiment, sleeve member 178 is secured to body 144 through engagement of corresponding threads on the radially inner surface 178*d* and the radially outermost surface 147 of body 144. Additionally, when sleeve member 178 is secured to body 144 as described above, and disposed within chamber 167, the radially outer surface 178*d* slidingly engages the radially inner surface 160*d* of sleeve 160.

Further, in this embodiment, a first or upper seal assembly 196' is disposed between the radially inner surface 178*d* of member 178 and the radially outermost surface 147 of body 144, and a second or lower seal assembly 196" is disposed between the radially outer surface 178*c* of member 178 and the radially inner surface 160*d* of sleeve 160. Upper seal assembly 196' includes an annular recess or seal gland 197' in surface 178*d* and an annular seal member 198' seated in gland 197', and lower seal assembly 196" includes an annular recess or seal gland 197" in surface 178*c* and an annular seal member 198". As will be explained in more detail below, seal assembly 196' restricts fluid flow between the surface 178*d* and the surface 147, and the seal assembly restricts fluid flow between the surface 178*c* and the surface 160*d* 196". Thus, sleeve member 178 separates chamber 167 into a first or upper subchamber 168, and a second or lower subchamber 166.

Referring still to FIGS. 7 and 8, an annular end cap 174 is secured to sleeve 160 at the upper end 160*a* and defines an upper end of chamber 167. Cap 174 includes a first or upper end 174*a*, a second or lower end 174*b* opposite the upper end 174*a*, a radially outer surface 174*c*, and a radially inner surface 174*d*. In this embodiment, cap 174 is secured to sleeve 160 through engagement of corresponding threads on the radially outer surface 174*c* and the radially inner surface 160*c*. Thus, the axial position of cap 174 relative to sleeve 160 is fixed. Additionally, when sleeve 160 is disposed about shank body 144 as shown in FIG. 7, the radially inner surface 174*d* of cap 174 slidingly engages the radially outer surface 147 of shank body 144. Further, cap 174 includes a downward facing annular shoulder 179 at is lower end 174*b*. A locking member 180 is also disposed within chamber 167. In this embodiment, locking member 180 is a lock ring including an upper radially oriented annular planar surface 184 and a upward facing frustoconical surface 182. In the embodiment shown in FIG. 8, ring 180 is disposed at the lower end 174*b* of cap 174 such that the surface 184 engages or abuts the shoulder 179.

A first or upper seal assembly 193' and a second or intermediate seal assembly 193" are each disposed between the radially inner surface 174*d* and the radially outer surface 147, and a third or lower seal assembly 193'" is disposed between the radially outer surface 174*c* and the radially inner surface 160*d* of sleeve 160. The intermediate seal assembly 193" is axially disposed between the upper seal assembly 193' and the lower seal assembly 193'". Upper seal assembly 193' and intermediate seal assembly 193" include annular recesses or seal glands 194', 194", respectively, in surface 174*d* and annular seal members 195', 195", respectively, seated in glands 194', 194", respectively. In addition, lower seal assembly 193'" includes an annular recess or seal gland 194'" in surface 174*c* and an annular seal member 195'" seated within gland 194'". As will be explained in more detail below, seal assemblies 193', 193" restrict fluid flow between the surface 174*d* and the surface 147, and the seal assembly 193'" restricts fluid flow between the surface 174*c* and the surface 160*d*.

Referring specifically now to FIG. 8, a plurality of engagement pins 190 are disposed within ports 149*a*, 149*b*, previously described, and each pin 190 includes a first or inner end 190*a*, and a second or outer end 190*b* opposite the inner end 190*a*. Each pin 190 is secured within one of the ports 149*a*, 149*b* through any suitable means known in the art. For example, in some embodiments, pins 190 are secured within each of the ports 149*a*, 149*b* through a threaded engagement between external threads disposed on each of the pins 190 and corresponding internal threads within the ports 149*a*, 149*b*. In this embodiment, each of the pins 190 is spring loaded such that the end 190*b* is biased radially outward from the corresponding port 149*a*, 149*b*.

Referring again to FIG. 7, an axial biasing member 172 is disposed within lower chamber 166 and is configured to bear against sleeve 160 and member 178 to bias sleeve 160 axially toward the drill bit seat 150 of shank 140. In this embodiment member 172 comprises a coiled spring that is helically wrapped around body 144 of shank 140; however, it should be appreciated that any suitable biasing member or device may be used while still complying with the principles disclosed herein. Member 172 includes a first or upper end 172*a* and a second or lower end 172*b* opposite the upper end 172*a*. Upper end 172*a* engages or abuts lower end 178*b* of sleeve member 178, and lower end 172*b* engages or abuts annular shoulder 162 on projection 161 of sleeve 160. Because sleeve member 178 is secured to body 144 as previously described, as sleeve 160 moves or translates axially toward the connector 142 (e.g., in the upward direction as shown in FIG. 7), member 172 is axially compressed such that end 172*b* moves toward end 172*a* thereby resulting in an increasing biasing force $F_{172}$ urging sleeve 160 toward seat 150 (e.g., in the downward direction as shown in FIG. 7). Additionally, as sleeve 160 moves or translates axially toward drill bit seat 150, member 172 extends such that end 172*b* moves away from end 172*a*, thereby decreasing the biasing force $F_{172}$.

Referring back now to FIGS. 2 and 3, in this embodiment, drill bit 120 is coupled to sleeve 160 through a pair of lift arms 110. Each lift arm 110 includes a first or upper end 110*a*, and a second or lower end 110*b* opposite the upper end 110*a*. Upper end 110*a* includes external threads 114 and extends through one of the throughbores 169 of one of the projections 163 on sleeve 160, previously described, such that arm 110 also extends through one of the guides 159 on seat 150. A bolt 116 or other suitable securing member including internal threads (not shown) is threadably engaged to upper end 110*a* through the external threads 114 to fix upper end 110*a* within throughbore 169 and thus secure arm 110 to sleeve 160. Lower end 110*b* includes a receptacle 112 that slidingly receives one of the hinge pins 136 of drill bit 120, previously described, such that bit 120 is rotatably coupled to arms 110 through the receptacles 112 and is configured to rotate about the axis of rotation 137. In this embodiment, a torsional biasing member (not shown) is disposed on one or both of the hinge pins 136 such that bit 120 is rotationally biased about the axis 137. Any suitable torsional biasing member known in the art may be used to rotationally bias bit 120 about the axis 137. For example, in some embodiments, the biasing member comprises a torsional spring disposed about one of the hinge pins 136 within the receptacle 112 of one of the arms 110 such that bit 120 is rotationally biased about the axis of rotation 137 by rotating the bit 120 about the axis of rotation 137 to wind the torsional spring prior to seating the bit 120 within the receptacle 152 of seat 150. In addition, in other embodiments, a hydraulic actuator may be employed to rotate bit 120 about axis 137.

Figure 10:
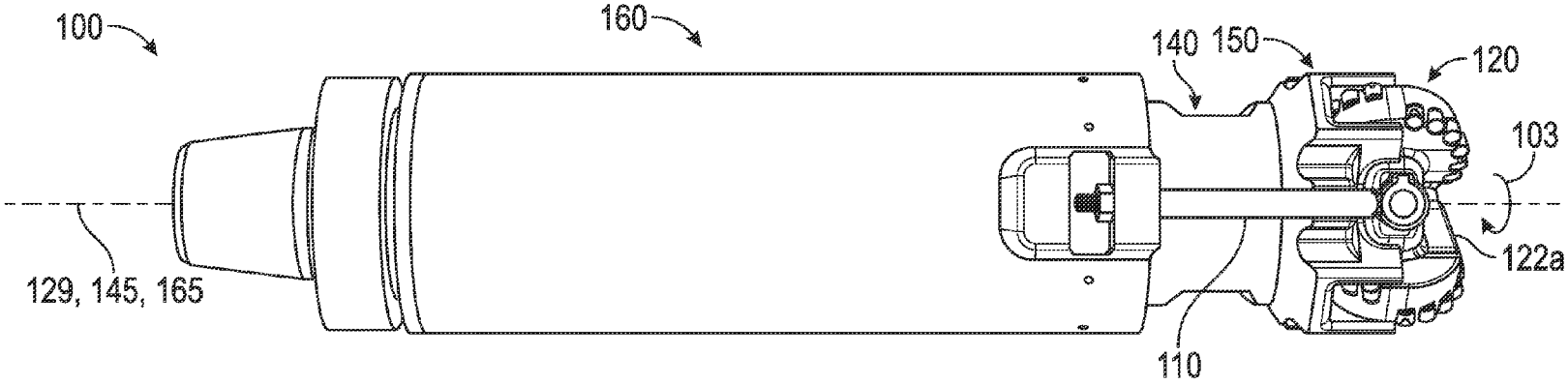
FIGS. 10 and 11 are sequential side views of the drilling assembly of FIG. 2 illustrating the axial translation of the sleeve relative to the shank and the rotation of the drill bit.

Referring again to FIGS. 1, 7 and 10, during drilling operations, drilling fluid (e.g., drilling mud) is pumped or otherwise flowed from the surface 14 through drillstring 30 to assembly 100. As the fluid enters assembly 100, it flows along flow bore 146 from upper end 140*a* toward seat 150. A portion of the fluids is directed through the ports 148 toward the upper subchamber 168. Due to the placement of the sealing assemblies 193', 193", 193''', 196', 196", previously described, as fluid flows into the upper subchamber 168, the pressure within subchamber 168 increases thereby resulting in an axially oriented force $F_{168}$ that overcomes the biasing force $F_{172}$ exerted by the member 172 and thus causes sleeve 160 to translate toward upper end 140*a* of shank 140. As sleeve 160 translates toward upper end 140*a*, bit 120 is received within the receptacle 152 of seat 150 such that one of the faces 122*a*, 122*b* is received therein. In the embodiment shown in FIG. 7, the second face 122*b* is initially received within the receptacle 152 such that blades 123-126 extending from face 122*b* are received within the recesses 156, 158. In particular, each of the primary blades 123, 125 is received within one of the primary recesses 156, and each of the secondary blades 124, 126 is received within one of the secondary recesses 158. In addition, each of the bores 128 are aligned with one of the nozzles 143 such that the second opening 128*b* is proximate the lower end 143*b* for each corresponding pair of bores 128 and nozzles 143. Thereafter, drilling assembly 100 is caused to rotate about the aligned axes 129, 145, 165, 31 along a cutting direction 103 with WOB applied such that the cutting face 132 on each of the primary cutter elements 130 engages with and shears off portions of the earthen formation 12. As bit 120 rotates about the axes 129, 145, 165, 31 as previously described, drilling fluids are forced through flow bore 146, nozzles 143, and bores 128 and are emitted out of the first face 122*a* to perform various functions as previously described above (e.g., cooling and lubricating the engagement between the cutter elements 130 and the earthen formation 12, carrying formation cuttings to the surface 14, etc.).

Figure 9:
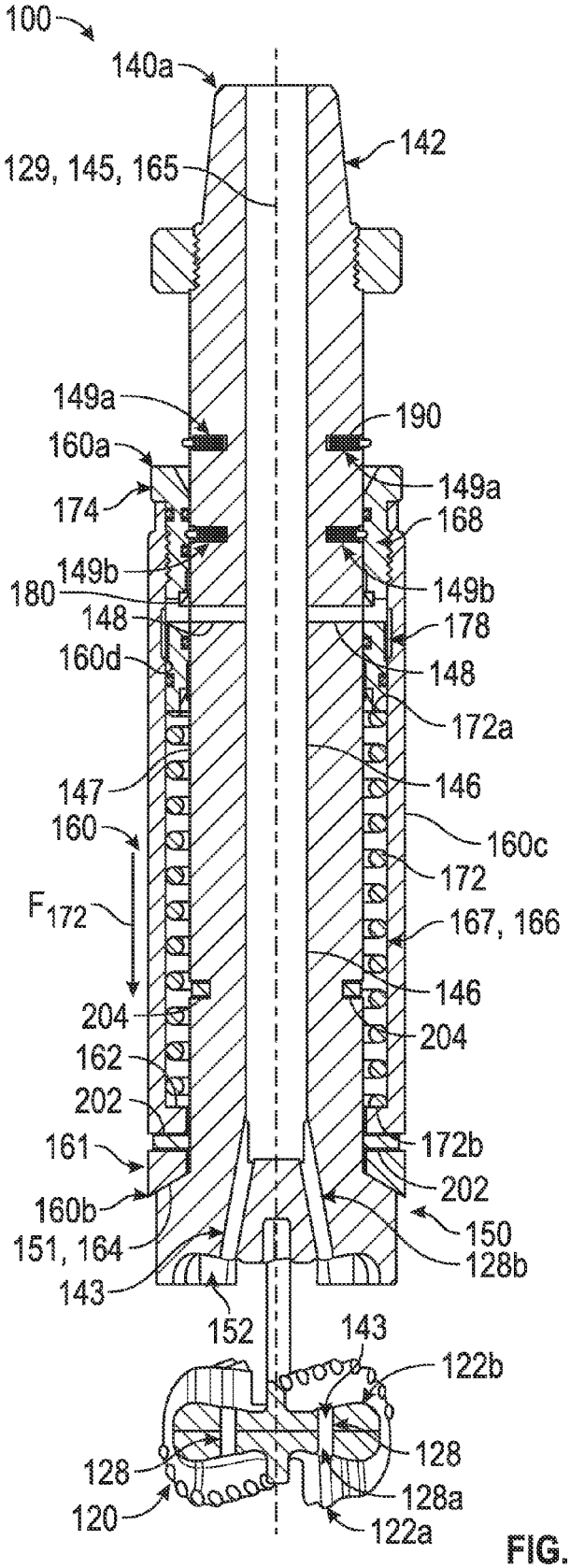
FIG. 9 is a schematic cross-sectional side view of the drilling assembly of FIG. 2 illustrating the axial translation of the sleeve relative to the shank.
Figure 11:
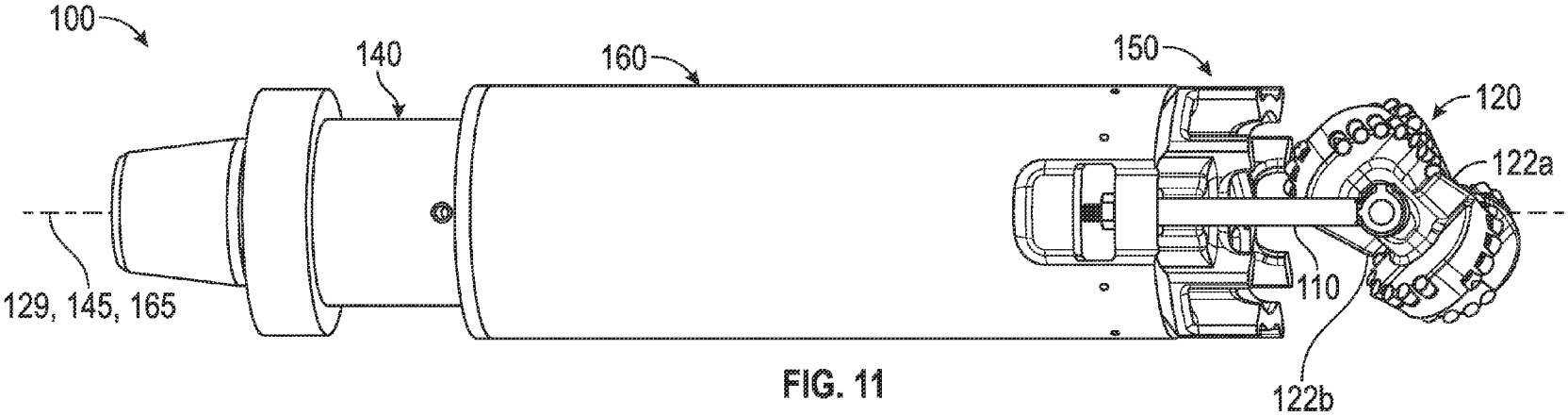

Referring now to FIGS. 1, 9 and 11, eventually, it becomes desirable to engage the earthen formation with second face 122*b* of bit 120 rather than first face 122*a* (e.g., due to wear of cutter elements 130 on face 122*a* or due to encountering a different strata within formation 12). Thus the assembly 100 is actuated to flip or rotate bit 120 about the axis 137 to expose the second face 122*b* to the earthen formation 12 such that drilling operations may continue. In particular, as is best shown in FIG. 9, once it is desired to rotate the bit 120 about the axis 137 to expose the second face 122*b* to the formation (e.g., formation 12), the flow of drilling fluid to the assembly 100 is either stopped or reduced such that the pressure within upper subchamber 168 and thus the force $F_{168}$ are no longer sufficient to overcome the biasing force $F_{172}$ exerted by member 172. As a result, the sleeve 160 translates axially toward seat 150, thereby also causing bit 120 to unseat from receptacle 152 (e.g., due to axial forces transferred through arms 110). In this embodiment, sleeve 160 translates toward seat 150 until the frustoconical shoulder 164 engages or abuts frustoconical shoulder 151 on seat 150. As is best shown in FIG. 11, in this embodiment because bit 120 is rotationally biased about the axis of rotation 137, when bit 120 is moved axially away from receptacle 152, bit 120 rotates approximately 180° about the axis 137 such that the first face 122*a* is axially positioned between the second face 122*b* and seat 150 and the second face 122*b* (and associated cutting structure 133) is fully exposed to the earthen formation. However, it should be appreciated that in other embodiments, any suitable method or device for rotating the bit 120 about the axis 137 may be utilized while still complying with the principles disclosed herein.

Once the desired cutting face (e.g., cutting face 122*b*) is fully exposed, the flow of drilling fluid is once again fully established through the drillstring 30 and flow bore 146 such that the pressure within upper subchamber 168 and thus the force $F_{168}$ are once again sufficient to overcome the force $F_{172}$ of member 172, thereby causing sleeve 160 to translate toward the upper end 140*a* in the manner previously described. As the sleeve 160 translates back toward the upper end 140*a*, first face 122*a* is received within the receptacle 152 such that blades 123-126 extending from face 122*a* are received within the recesses 156, 158. In particular, each of the primary blades 123, 125 is received within one of the primary recesses 156, and each of the secondary blades 124, 126 is received within one of the secondary recesses 158. In addition, each of the bores 128 are aligned with one of the nozzles 143 such that the second opening 128*a* is disposed proximate the lower end 143*b* for each corresponding pair of bores 128 and nozzles 143. Thereafter, assembly 100 and bit 120 are again rotated about the axes 129, 145, 165 along the cutting direction 103 to engage the earthen formation with the cutting surfaces 132 of the cutter elements 130 of face 122*b*.

Figure 12:
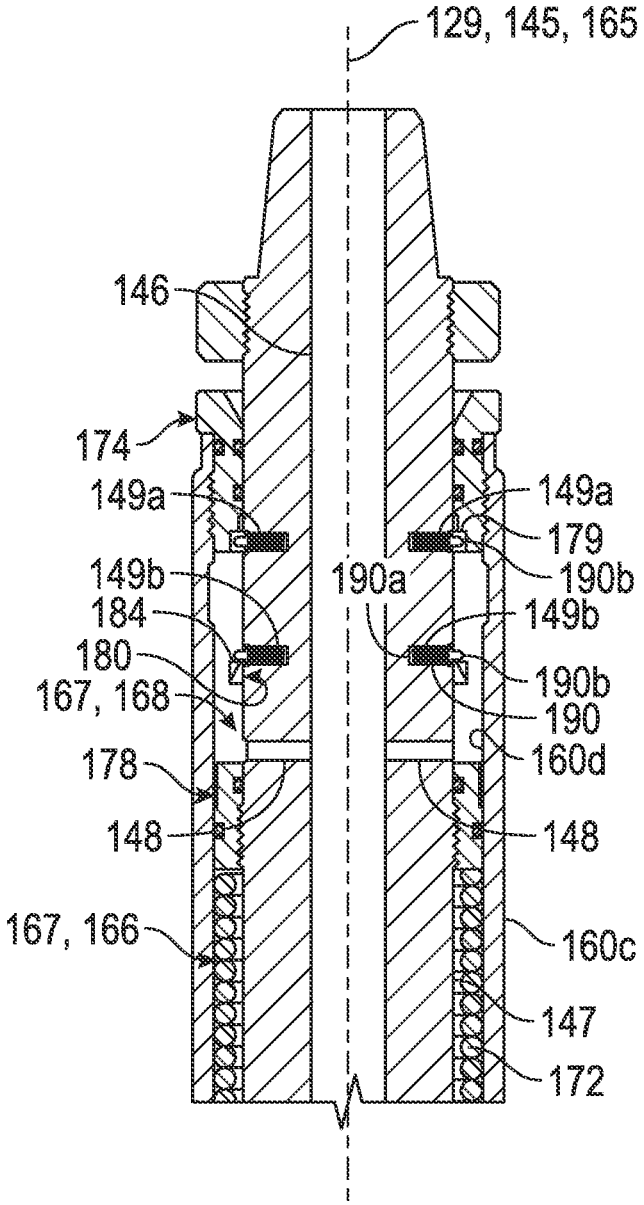
FIG. 12 is an enlarged schematic cross-sectional side view of the drilling assembly of FIG. 2 after the axial translation of the sleeve relative to the shank.

Referring now to FIGS. 7, 9, and 12, in this embodiment, once the bit 120 is rotated about the axis 137 to change or alternate between the first and second faces 122*a*, 122*b*, respectively, the assembly 100 is prevented from once again alternating between the faces 122*a*, 122*b* thereafter. In particular, as is best shown in FIG. 7, as previously described, initially, the bit 120 is seated within the receptacle 152 such that the blades 123-126 of the second face 122*b* are received within the recesses 156, 158. In addition, while in this configuration, the outer ends 190*b* of each pin 190 disposed within the ports 149*a* engage the frustoconical surface 182 of the lock ring 180, thereby maintaining the engagement between ring 180 and shoulder 179. As best shown in FIG. 9, when the assembly 100 is actuated to rotate the bit 120 about the axis 137 as previously described, the end cap 174 translates axially with sleeve 160 toward the seat 150 such that the ring 180 is axially disposed below the ports 149*b* and associated pins 190. As is best shown in FIGS. 7 and 12, once the flow of drilling fluid is once again fully established through flow bore 146 and sleeve 160 translates back toward the upper end 140*a*, the outer ends 190*b* of pins 190 within ports 149*b* engage with the planar surface 184 on ring 180 and thus unseat ring 180 from shoulder 179 as end cap 174 continues to move axially toward end 140*a*. As is best shown in FIG. 12, once sleeve 160 substantially returns to its initial position (e.g., FIG. 7), the annular shoulder 179 is once again axially disposed above the ends 190*b* of pins 190 disposed within ports 149*a*. As a result, sleeve 160 is prevented from once again translating toward seat 150 due to the engagement between the outer ends 190*b* of the pins 190 disposed within the ports 149*a* and the annular shoulder 179 of the end cap 178.

Referring briefly again to FIGS. 7 and 9, in some embodiments, shear pins 200 may be utilized to provide additional control over the actuation of sleeve 160 relative to shank 140. In particular, in the embodiment shown in FIGS. 7 and 9, projection 161 of sleeve includes a plurality of radially oriented ports 202 and body 144 includes a plurality of corresponding radially oriented ports 204. When assembly 100 is in the arrangement shown in FIG. 7, the ports 202 are substantially axially and circumferentially aligned with the ports 204, and a shear pin 200 is inserted within each of the aligned ports 202, 204. During operation, as the flow of drilling fluids to assembly 100 is reduced, the net force acting on sleeve 160 (e.g., the difference between $F_{172}$ and $F_{168}$) eventually increases to a point that the portion of each pin 200 that is disposed within the ports 204 is sheared axially away from the portion of each pin 200 that is disposed within the port 202, thus allowing sleeve 160 to translate in the manner previously described. In some embodiments, pins 200 are threadably engaged within ports 202 on sleeve 160. Also, in at least some embodiments, the sizing, arrangement, and number of pins 200 (and thus ports 202, 204) is chosen to correspond with a pre-selected pressure within the flow bore 146 to help ensure that sleeve 160 will not unintentionally translate during drilling operations (e.g., due to a sudden fluctuation in the pressure and/or flow of drilling fluids).

In the manner described, a drill bit assembly (e.g., drilling assembly 100) is utilized to allow a different or alternate bit face to be selectively exposed to the earthen formation (e.g., formation 12) within a subterranean borehole (e.g., borehole 11) without tripping the drill bit assembly and associated drillstring (e.g., drillstring 30) to the surface (e.g., surface 14). As a result, through use of a drill bit assembly (e.g., assembly 100) in accordance with the principles disclosed herein, the overall costs of drilling operations may be reduced, thus making the production subterranean resources (e.g., hydrocarbons) more economically feasible.

While embodiments disclosed herein have included a drill bit 120 with a pair of bit faces 122*a*, 122*b*, it should be appreciated that in other embodiments, bit 120 may include more or less than two bit faces 122*a*, 122*b* while still complying with the principles disclosed herein. In addition, while the bit faces 122*a*, 122*b* have been described as being identical, in other embodiments, the faces 122*a*, 122*b* (or any other faces included on the bit 120) may not be identical while still complying with the principles disclosed herein. Further, while each face 122*a*, 122*b* of bit 120 have been described and shown as a fixed cutter bit, it should be appreciated that in other embodiments, the faces (e.g., faces 122*a*, 122*b*) can comprise other types of drill bits known in the art.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A drill bit assembly for drilling a borehole in an earthen formation, the drill bit assembly comprising:

a shank having a central shank axis, a first end, and a second end opposite the first end, wherein the shank includes a fluid flow bore extending axially from the first end toward the second end, and wherein the shank includes a drill bit seat disposed at the second end;

a sleeve concentrically disposed about the shank, wherein the sleeve is configured to translate axially relative to the shank;

an annular chamber radially positioned between the sleeve and the shank and in fluid communication with the fluid flow bore; and a bit body rotatably coupled to the sleeve, wherein the bit body includes a first bit face having a first cutting structure configured to engage the earthen formation and a second bit face having a second cutting structure configured to engage the earthen formation;

wherein the bit body is configured to rotate about the shank axis in a cutting direction and configured to rotate about an axis of rotation oriented orthogonal to the shank axis to selectively expose one of the first cutting structure and the second cutting structure to the earthen formation;

wherein the sleeve and the bit body are configured to translate axially relative to the shank in response to a change in a fluid pressure within the annular chamber;

wherein the bit body has a first position with the first cutting structure seated within the drill bit seat and a second position with the bit body axially spaced from the drill bit seat; and wherein the bit body is configured to transition from the first position to the second position in response to a decrease in the fluid pressure within the annular chamber.

2. The drill bit assembly of claim 1, wherein the bit body is configured to rotate about the second axis of rotation 180° to expose the second cutting structure to the earthen formation with the bit body in the second portion.

3. The drill bit assembly of claim 2, wherein the bit body is configured to transition from the first position to the second position only once.

4. The drill bit assembly of claim 3, further comprising:

an engagement pin biased radially outward from a receptacle on a radially outer surface of the shank into the annular chamber;

a locking member disposed within the annular chamber, wherein the locking member includes an annular planar surface and a radially inner frustoconical surface;

wherein the locking member has a first position with the frustoconical surface slidingly engaging the engagement pin as the bit body transitions from the first position to the second position and a second position disposed axially between the engagement pin and the bit body after the bit body is transitioned to the second position.

5. The drill bit assembly of claim 1, wherein the first bit face or the second bit is a fixed cutter bit face including:

a radially extending blade; and a plurality of cutter elements mounted to a cutter-supporting surface of the blade.

6. The drill bit of claim 1, wherein the bit body comprises:

a first portion including the first bit face; and a second portion including the second bit face; and wherein the first portion is removably coupled to the second portion.

7. The drill bit of claim 6, wherein the first portion is coupled to the second portion through a plurality of bolts, each of the bolts extending through a pair of aligned mating bores extending axially through the first portion and the second portion.

8. A drill bit assembly for drilling a borehole in an earthen formation, the drill bit assembly comprising:

a shank having a central shank axis, a first end, and a second end opposite the first end, wherein the shank includes a drill bit seat at the second end and a central flow bore extending axially from the first end toward the second end, a sleeve disposed about the shank and configured to translate axially relative to the shank;

a drill bit rotatably coupled to the sleeve, the drill bit including:

a first bit face having a first cutting structure configured to engage the earthen formation; and a second bit face having a second cutting structure configured to engage the earthen formation;

wherein the drill bit is configured to rotate about the about the shank axis in a cutting direction;

wherein the drill bit is configured to rotate about an axis of rotation that is orthogonal to the shank axis to selectively expose the first cutting surface or the second cutting surface to the earthen formation; and wherein the drill bit seat is configured to mate with and receive the first bit face or the second bit face;

wherein the drill bit has a first position with the first cutting structure received within the drill bit seat and a second position axially spaced from the drill bit seat;

wherein the sleeve is configured to move the drill bit axially relative to the shank to transition the drill bit between the first position and the second position; and wherein the sleeve is prevented from axially translating relative to the shank after the drill bit is transitioned from the second position to the first position.

9. The drill bit assembly of claim 8, wherein the drill bit further includes a pair of hinge pins extending radially outward from radially opposite sides of the drill bit along the axis of rotation; and wherein the drill bit is rotatably coupled to the sleeve with a pair of arms, each of the arms mounted to the sleeve and including a receptacle to the receives one of the hinge pins.

10. The drill bit assembly of claim 9, wherein the drill bit is biased to rotate in a first direction about the axis of rotation.

11. The drill bit assembly of claim 8, wherein the first bit face is a fixed cutter bit face including:

a first radially extending blade; and a first plurality of cutter elements mounted to a cutter-supporting surface of the first blade;

wherein the second bit face is a fixed cutter bit face including:

a second blade extending radially along the second bit face; and a second plurality of cutter elements mounted to a cutter-supporting surface of the second blade; and wherein the drill bit seat is configured to mate with and receive the first bit face and the second bit face.

12. The drill bit assembly of claim 8, further comprising:

a biasing member configured to apply an axial biasing force to the drill bit; and a chamber radially positioned between the sleeve and shank;

wherein a fluid pressure within the chamber is configured to at least partially oppose the axial biasing force.

13. The drill bit assembly of claim 12, wherein the shank further includes a fluid flow port in fluid communication with the central flow bore and the chamber.

14. A method for drilling a borehole in an earthen formation, the method comprising:

(a) rotatably coupling a bit body to a sleeve that is concentrically and moveably disposed about a shank, wherein the shank includes a central shank axis, a first end, a second end opposite the first end, a fluid flow bore extending axially from the first end toward the second end, and a drill bit seat disposed at the second end, and wherein the sleeve is configured to translate axially relative to the shank;

wherein the bit body includes a first bit face having a first cutting structure configured to engage the earthen formation and a second bit face having a second cutting structure configured to engage the earthen formation;

(b) rotating the bit body, the sleeve, and the shank about the central shank axis in a cutting direction after (a);

(c) engaging the earthen formation with the second bit face and second cutting structure during (b);

(d) decreasing a pressure within an annular chamber radially positioned between the sleeve and the shank, wherein the annular chamber is in fluid communication with the fluid flow bore;

(e) translating the sleeve and bit body from a first position with the first cutting structure seated within the drill bit seat in a first axial direction relative to the shank to a second position with the bit body axially spaced from the drill bit seat after (c) and in response to (d);

(f) rotating the bit body about an axis of rotation oriented orthogonal to the shank axis during (d) to expose the first bit face and first cutting structure to the earthen formation;

(g) rotating the bit body about the shank axis after (f); and (h) engaging the earthen formation with the first bit face and first cutting structure during (g).

15. The method of claim 14, further comprising:

(i) seating the first bit face within the drill bit seat during (b), and (c); and (j) seating the second bit face within the drill bit seat during (g) and (h).

16. The method of claim 15, further comprising:

(k) biasing the bit body axially away from the drill bit seat; and (l) preventing the body from moving axially away from the drill bit seat during (b), (c), (g), and (h).

17. The method of claim 14, further comprising:

(m) translating the sleeve and bit body relative to the shank in a second axial direction after (e), the second axial direction being axially opposite the first axial direction; and (n) increasing the pressure within the annular chamber during (m).

18. The method of claim 17, further comprising:

(o) preventing axial translation of the sleeve and bit body in the first direction after (m).

* * * * *